US010981702B2

(12) United States Patent
Yan et al.

(10) Patent No.: US 10,981,702 B2
(45) Date of Patent: Apr. 20, 2021

(54) DRIP HOSE

(71) Applicants: SHENZHEN BEAUTY STAR CO., LTD, Guangdong (CN); GUANGZHOU BEAUTY STAR CO., LTD, Guangdong (CN)

(72) Inventors: Debin Yan, Guangdong (CN); Shenzhou Li, Guangdong (CN); Jing Ouyang, Guangdong (CN)

(73) Assignees: SHENZHEN BEAUTY STAR CO., LTD, Shenzhen (CN); GUANGZHOU BEAUTY STAR CO., LTD, Guangzhou (CN)

( * ) Notice: Subject to any disclaimer, the term of this patent is extended or adjusted under 35 U.S.C. 154(b) by 0 days.

(21) Appl. No.: 16/737,898

(22) Filed: Jan. 8, 2020

(65) Prior Publication Data

US 2020/0140155 A1 May 7, 2020

Related U.S. Application Data

(63) Continuation of application No. PCT/CN2018/122109, filed on Dec. 19, 2018.

(30) Foreign Application Priority Data

Mar. 28, 2018 (CN) ..... 201820433870.1

(51) Int. Cl.
*B65D 47/18* (2006.01)

(52) U.S. Cl.
CPC ..... *B65D 47/18* (2013.01)

(58) Field of Classification Search
CPC ..... B65D 47/18; B65D 47/121; B65D 47/06; A45D 2200/054; B01L 3/0282
USPC ..... 222/420, 421, 422, 92, 106, 107; 604/295, 298
See application file for complete search history.

(56) References Cited

U.S. PATENT DOCUMENTS 2,663,463 A * 12/1953 Benbury ..... B65D 41/0414 222/215
5,246,145 A * 9/1993 Leoncavallo ..... B65D 47/0885 215/216
10,179,680 B2 * 1/2019 Kim ..... B65D 47/121
2008/0067194 A1 * 3/2008 Faurie ..... B65D 1/32 222/189.07

(Continued)

FOREIGN PATENT DOCUMENTS

CN 1538923 A 10/2004

OTHER PUBLICATIONS

International Search Report of PCT Patent Application No. PCT/CN2018/122109 dated Mar. 22, 2019.

*Primary Examiner* — Lien M Ngo

(57) ABSTRACT

The present disclosure discloses a drip hose, comprising a hose body and a drip head inner plug. A sealing post is fixed in the opening of the hose body, a sealing ring is fixed in the interior of the drip head inner plug, the drip head inner plug is capped in the hose body, the sealing post blocks the sealing ring, the sealing post, the sealing ring and the drip head inner plug jointly form a storage space; a small liquid outlet aperture is arranged in the sealing ring, and a small liquid outlet hole is arranged in the head of the drip head inner plug, and the small liquid outlet aperture is in communication with both the storage space and the opening of the hose body.

9 Claims, 8 Drawing Sheets

(56) References Cited

U.S. PATENT DOCUMENTS

2014/0336596 A1* 11/2014 Wochele ..... B65D 47/20
604/298

* cited by examiner

DRIP HOSE

CROSS-REFERENCE TO RELATED APPLICATION

This application is a continuation of International Application No. PCT/CN2018/122109, filed on Dec. 19, 2018, which claims the benefit of Chinese Patent Application No. 201820433870.1 filed on Mar. 28, 2018, the contents thereof are incorporated herein by reference in its entirety.

TECHNICAL FIELD

The present disclosure relates to the field of packaging containers, and in particular to a drip hose.

BACKGROUND

In people's daily lives, daily necessities contained in packaging containers such as hoses are often used. When using, the user squeezes the hose body directly to push out the content.

However, for the ordinary hose on the market, when the content is squeezed out, the liquid sometimes flows out of the small outlet too fast under large pressure force, and the phenomenon of jetting water often occurs, which is inconvenient to use and easy to cause waste of content.

SUMMARY

The technical problem to be solved by the present disclosure is to provide a drip hose, which aims to solve the problem that the common hose in the prior art has a too high liquid discharge speed, inconvenient to use, and easy to cause waste of content.

In order to solve the above technical problem, the embodiment of the present disclosure provides a drip hose comprising a hose body and a hollow drip head inner plug, wherein a sealing post is fixed in the opening of the hose body, a sealing ring is fixed in the interior of the drip head inner plug, the drip head inner plug is capped in the opening of the hose body, and the outer wall of the drip head inner plug is interference-fitted with the inner wall of the opening of the hose body, the sealing post correspondingly blocks the sealing ring, the sealing post, the sealing ring and the hollow inner cavity of the drip head inner plug jointly form a storage space; a small liquid outlet aperture is arranged in the sealing ring, a small liquid outlet hole is arranged on the head of the drip head inner plug, and the small liquid outlet aperture is in communication with both the storage space and the opening of the hose body, the small liquid outlet hole is in communication with the storage space, and the size of the small liquid outlet hole is larger than that of the small liquid outlet aperture.

Preferably, the small liquid outlet hole has a reverse tapered shape.

Preferably, the small liquid outlet hole with reverse tapered shape has a circular arc chamfer near the head of the drip head inner plug.

Preferably, the small liquid outlet aperture is a strip groove and the strip groove is disposed on the inner wall of the sealing ring.

Preferably, the inner wall of the opening of the hose body is provided with a buckling position groove and the outer wall of the drip head inner plug is provided with a buckling position protrusion, and the buckling position protrusion is engaged with the buckling position groove.

Preferably, the hose body further comprises a skirt, the sealing post and the skirt jointly block the opening of the hose body, and the skirt is provided with at least one through hole for liquid discharge.

Preferably, the head of the drip head inner plug is provided with an applicator head for facilitating the application of the content.

Preferably, the drip head inner plug is integrally formed.

Preferably, the drip hose further comprises a cover that is covered on the drip head inner plug and threadedly connected to the hose body.

Preferably, a plug is disposed on the cover at a position corresponding to the small liquid outlet hole, and the plug blocks the small liquid outlet hole.

Compared with the prior art, the embodiments of the present disclosure have the following beneficial effects that the drip hose comprises the hose body and the hollow drip head inner plug. By capping the drip head inner plug in the opening of the hose body, the sealing post of the hose body, the sealing ring of the drip head inner plug and the hollow inner cavity of the drip head inner plug jointly form the storage space. At the same time, the small liquid outlet aperture is arranged in the sealing ring, and the small liquid outlet hole is arranged in the head of the drip head inner plug, and the aperture size of the small liquid outlet hole is larger than the aperture size of the small liquid outlet aperture. By using the liquid outlet small hole and the small liquid outlet aperture of different sizes, the content will flow from the small liquid outlet aperture into the storage space when the drip hose is squeezed, and the content will flow out of the small liquid outlet hole and a drip effect will appear after the storage space is full of content. The drip hose does not have a too fast flow rate, there is a buffering process for liquid outflow, and then the liquid slowly flows out from the small liquid outlet hole drop by drop, which is convenient for consumers to use, and does not cause waste of content.

BRIEF DESCRIPTION OF THE DRAWINGS

In order to more clearly illustrate the technical solutions in the embodiments of the present disclosure, drawings used in the description of the embodiments will be briefly described below. Obviously, the drawings in the following description are some embodiments of the present disclosure. Those skilled in the art can also obtain other drawings based on these drawings without any creative efforts.

DESCRIPTION OF THE EMBODIMENTS

To make the foregoing objectives, technical solutions and advantages of the present disclosure clearer and more comprehensible, the following clearly and completely describes the technical solutions in the embodiments of the present disclosure with reference to the accompanying drawings and embodiments of the present disclosure. It should be understood that the specific embodiments described herein are merely illustrative of the present disclosure and are not intended to limit the disclosure.

Figure 1:
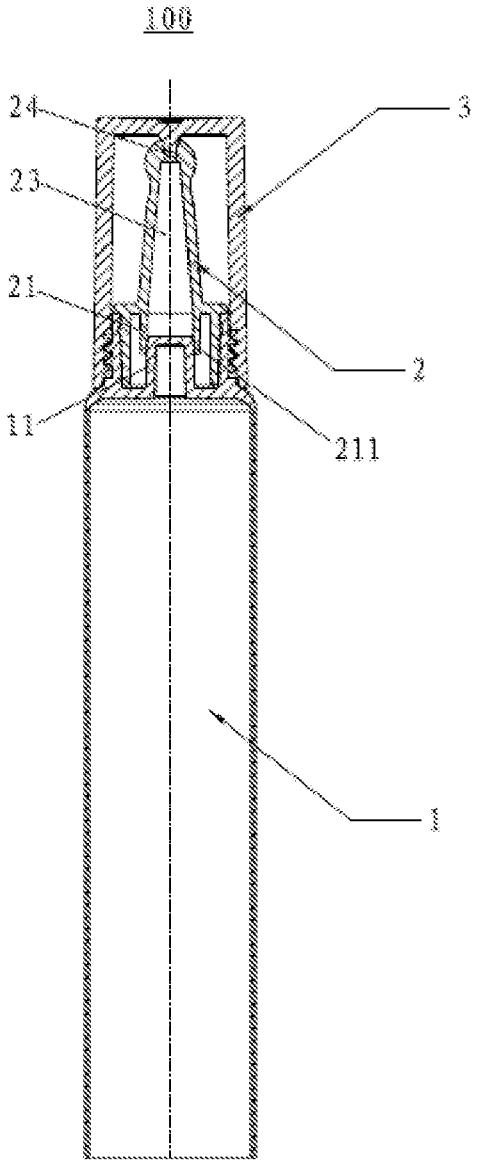
FIG. 1 is a schematic view showing the overall structure of the drip hose according to an embodiment of the present disclosure.
Figure 2:
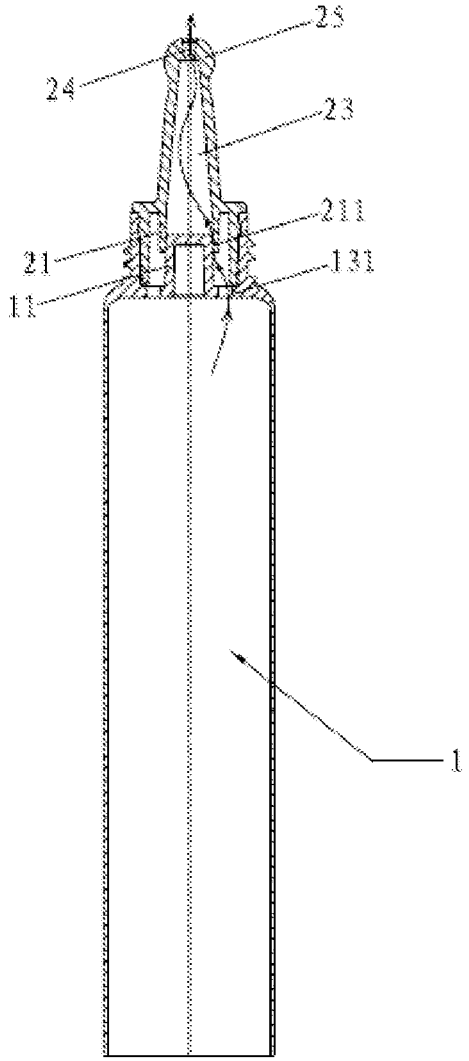
FIG. 2 is a schematic view showing the structure of FIG. 1 after removing the cover.

As shown in FIG. 1, an embodiment of the present disclosure provides a drip hose 100 comprising a hose body 1, a hollow drip head inner plug 2 and a cover 3.

In particular, referring to FIGS. 2 to 7, a sealing post 11 is fixed in the opening of the hose body 1, and a sealing ring 21 is fixed in the interior of the drip head inner plug 2. The drip head inner plug 2 is capped in the opening of the hose body 1, and the outer wall (not labeled) of the drip head inner plug 2 and the inner wall (not labeled) of the opening of the hose body 1 are interference-fitted to form a sealed structure. In one embodiment of the present disclosure, the inner wall of the opening portion of the hose body 1 is provided with a buckling position groove 12, and the outer wall of the drip head inner plug 2 is provided with a buckling position protrusion 22, the buckling position protrusion 22 is engaged with the buckling position groove 12 to fix the tightening of the drip head inner plug, and the firmness of the connection between the hose body 1 and the drip head inner plug 2 is enhanced.

Figure 3:
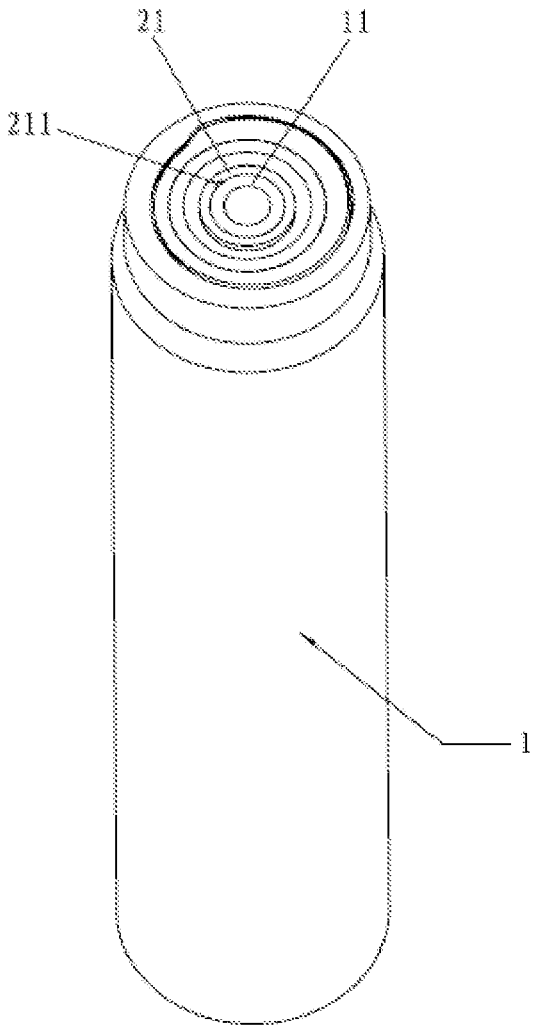
FIG. 3 is a schematic structural view of the cross section of FIG. 2.
Figure 4:
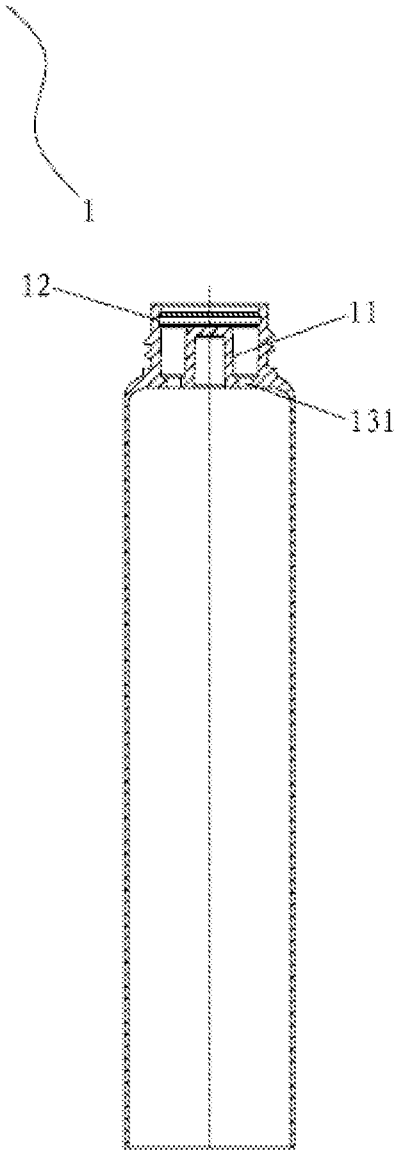
FIG. 4 is a schematic structural view of the hose body of FIG. 1.
Figure 7:
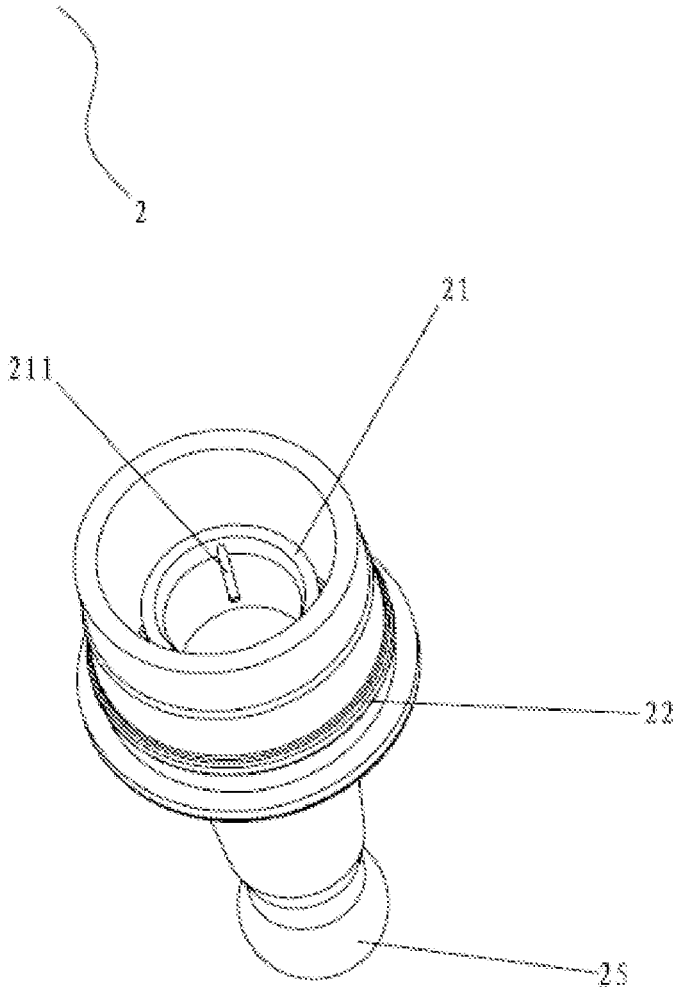
FIG. 7 is a three-dimensional structural view of another angle of the drip head inner plug of FIG. 1.

The sealing post 11 correspondingly seals and blocks the sealing ring 21, and the sealing post 11, the sealing ring 21 and the inner hollow cavity of the drip head inner plug 2 jointly form a storage space 23. A small liquid outlet aperture 211 is arranged on the sealing ring 21, a small liquid outlet hole 24 is arranged on the head of the drip head inner plug 2, and the liquid outlet small aperture 211 is in communication with both the storage space 23 and the opening of the hose body 1, the small liquid outlet hole 24 is in communication with the storage space 23, and the size of the small liquid outlet hole 24 is larger than the size of the small liquid outlet aperture 211. Referring to FIG. 3 and FIG. 7, in the embodiments of the present disclosure, the small liquid outlet aperture 211 is a strip groove, and the strip groove 211 is disposed on the inner wall of the sealing ring 21, and together with the outer wall of the sealing post 11 forms a passage for the content to pass through. The strip groove 211 in the embodiments of the present disclosure is only a preferred embodiment, but is not limited to the specific structure of the small liquid outlet aperture 211.

The drip hose 100 comprises a small liquid outlet hole 24 and a small liquid outlet aperture 211, and they have different sizes, both the small liquid outlet hole 24 and the small liquid outlet aperture 211 have small sizes, meanwhile, since the liquid itself has a character of adhesion such that when the drip hose 100 is squeezed, the content firstly flows into the storage space 23 from the small liquid outlet aperture 211, and after the storage space 23 is filled with content, the content will then flow out of the small liquid outlet hole 24 and a drip effect occurs. The drip hose 100 does not have an excessively fast flow rate, there is a buffering process for liquid outflow, and then the liquid slowly flows out from the small liquid outlet hole 24 drop by drop, which is convenient for consumers to use, and does not cause waste of content.

In the above embodiment, the small liquid outlet hole 24 has a reverse tapered shape, and the small liquid outlet hole 24 with reverse tapered shape has a circular arc chamfer 241 near the head of the drip head inner plug 2. The shape of the head of the drip head inner plug 2 is designed to be round, so that the content will not eject suddenly from the small liquid outlet hole 24 when it is extruded; and the small liquid outlet hole 24 with reverse tapered shape is advantageous for the accumulation of the content at the opening to form a drip. After use, since the hose body 1 will rebound, the content extruded at the small liquid outlet hole 24 will be sucked back into the storage space 23 to ensure the clean and hygiene of the small liquid outlet hole 24, not to cause waste of the extruded content, and further to improve the utilization rate of the content.

Figure 5:
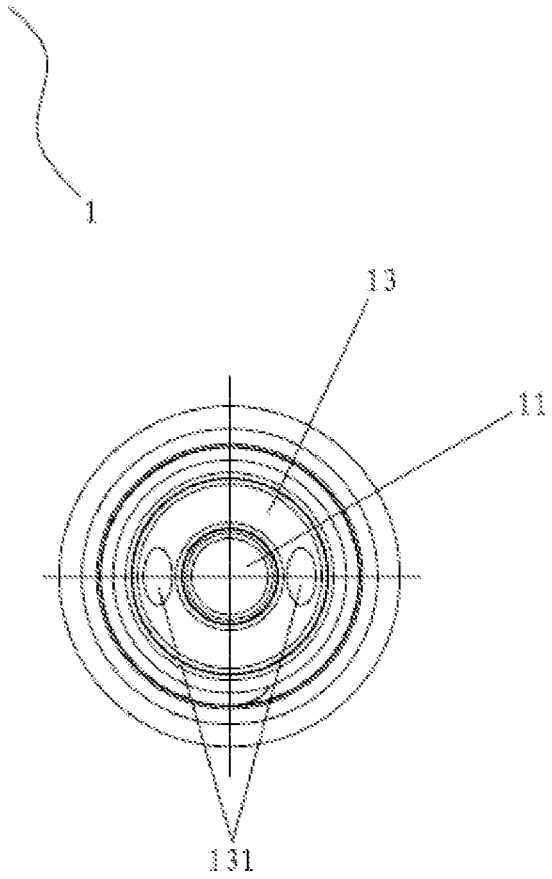
FIG. 5 is a top view of FIG. 4.

Referring to FIG. 5, the hose body 1 further comprises a skirt 13, the sealing post 11 and the skirt 13 jointly block the opening of the hose body 1, and the skirt 13 is provided with at least one through hole 131 for liquid discharge. The specific content flow path is as shown by the arrow in FIG. 2, the content of the hose body 1 flows out of the through hole 131 when the hose body 1 is squeezed, and then flows into the storage space 23 through the small liquid outlet aperture 211, after the storage space 23 is full of content, the content will flow out of the small liquid outlet hole 24, and a drip effect will occur.

Figure 6:
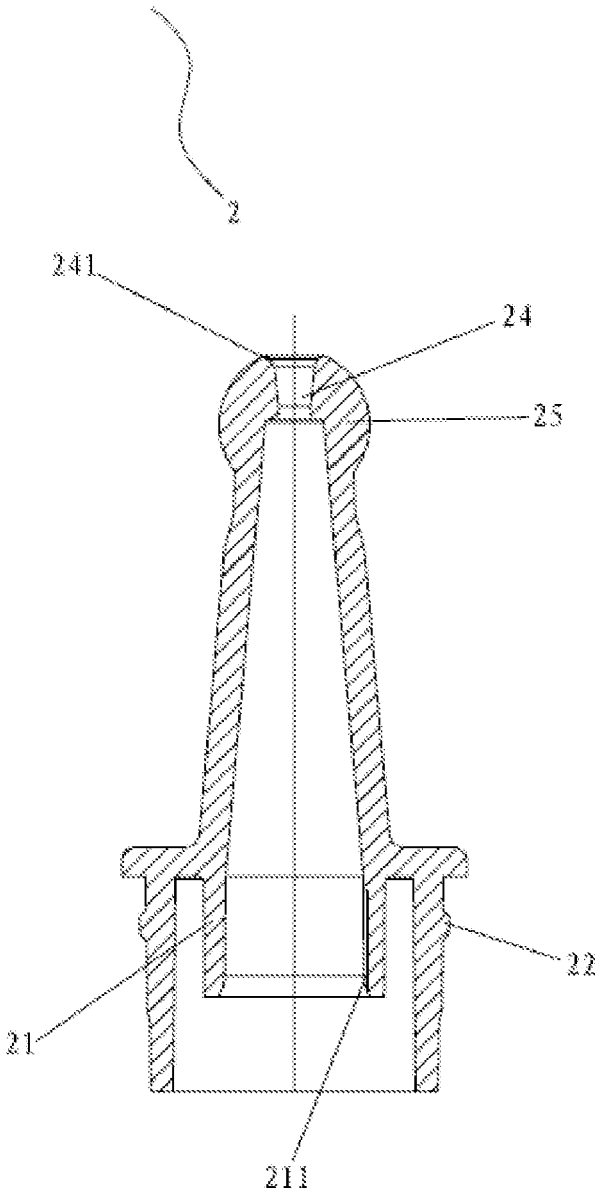
FIG. 6 is a schematic structural view of the drip head inner plug of FIG. 1.

Referring to FIG. 6, the head of the drip head inner plug 2 is provided with an applicator head 25. After the content is extruded, the content can be directly applied by the applicator head 25 to facilitate consumer use. In addition, in the above embodiment, the drip head inner plug 2 is integrally formed, but is not limited to the specific structural form of the drip head inner plug 2.

Figure 8:
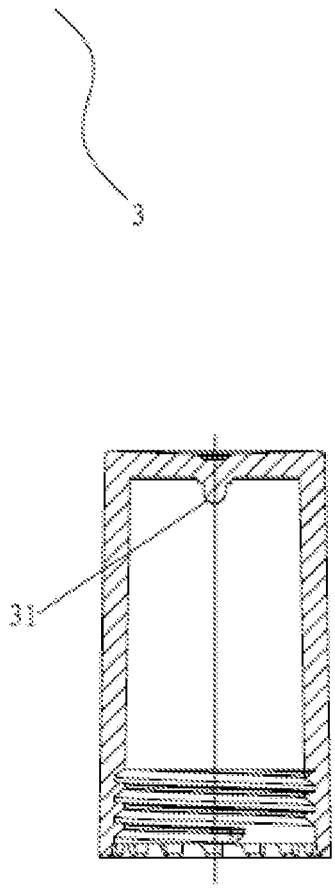
FIG. 8 is a schematic view showing the structure of the cover of FIG. 1.

Referring to FIG. 1 and FIG. 8, the cover 3 is covered on the drip head inner plug 2 and threadedly connected to the hose body 1 to protect the drip head inner plug 2 and prevent dust from entering the drip head inner plug 2. On the other hand, the cover 3 is provided with a plug 31 at a position corresponding to the small liquid outlet hole 24, and the plug 31 is arranged at the small liquid outlet hole 24 to function as a seal.

In summary, the drip hose 100 provided by the embodiments of the present disclosure does not have too fast flow rate, there is a buffering process for liquid outflow, and the liquid slowly flows out from the small liquid outlet hole 24 drop by drop, which is convenient for consumers to use, and does not cause waste of content.

The above is only the preferred embodiment of the present disclosure, and is not intended to limit the present disclosure. Any modifications, equivalent substitutions and improvements made within the spirit and principle of the present disclosure should be included in the protection scope of the present disclosure.

What is claimed is:

1. A drip hose comprising a hose body and a hollow drip head inner plug, wherein a sealing post is fixed in the opening of the hose body, a sealing ring is fixed in the interior of the drip head inner plug, the drip head inner plug is capped in the opening of the hose body, and the outer wall of the drip head inner plug is interference-fitted with the inner wall of the opening of the hose body, the sealing post correspondingly blocks the sealing ring, the sealing post, the sealing ring and the hollow inner cavity of the drip head inner plug jointly form a storage space; a small liquid outlet aperture is arranged on the sealing ring, a small liquid outlet hole is arranged on the head of the drip head inner plug, and the small liquid outlet aperture is in communication with both the storage space and the opening of the hose body, the small liquid outlet hole is in communication with the storage space, and the small liquid outlet hole has a size larger than that of the small liquid outlet aperture, the small liquid outlet aperture is a strip groove, and the strip groove is disposed on the inner wall of the sealing ring, wherein the strip groove is a passage, the passage is formed by the combination of the sealing ring and the sealing post.

2. The drip hose of claim 1, wherein the small liquid outlet hole has a reverse tapered shape.

3. The drip hose of claim 2, wherein the small liquid outlet hole with reverse tapered shape has a circular arc chamfer near the head of the drip head inner plug.

4. The drip hose of claim 1, wherein the inner wall of the opening of the hose body is provided with a buckling position groove, and the outer wall of the drip head inner plug is provided with a buckling position protrusion, and the buckling position protrusion is engaged with the buckling position groove.

5. The drip hose of claim 1, wherein the hose body further comprises a skirt, the sealing post and the skirt jointly block the opening of the hose body, and the skirt is provided with at least one through hole for liquid discharge.

6. The drip hose of claim 1, wherein the head of the drip head inner plug is provided with an applicator head for facilitating the application of the content.

7. The drip hose of claim 1, wherein the drip head inner plug is integrally formed.

8. The drip hose of claim 1, wherein the drip hose further comprises a cover that is covered on the drip head inner plug and threadedly connected to the hose body.

9. The drip hose of claim 8, wherein a plug is disposed on the cover at a position corresponding to the small liquid outlet hole, and the plug blocks the small liquid outlet hole.

* * * * *